US006827118B2

(12) United States Patent
Wienands et al.

(10) Patent No.: US 6,827,118 B2
(45) Date of Patent: Dec. 7, 2004

(54) DEVICE FOR THE PLACEMENT AND FIXING OF A SHEET OF FILAMENTS FOR THE PRODUCTION OF SCRIMS

(75) Inventors: Christian Wienands, Bad Steben/Thierbach (DE); Michael Unglaub, Naila (DE)

(73) Assignee: LIBA Maschinenfabrik GmbH, Naila (DE)

( * ) Notice: Subject to any disclaimer, the term of this patent is extended or adjusted under 35 U.S.C. 154(b) by 294 days.

(21) Appl. No.: 09/893,913

(22) Filed: Jun. 28, 2001

(65) Prior Publication Data

US 2002/0006496 A1 Jan. 17, 2002

(30) Foreign Application Priority Data

Jun. 30, 2000 (DE) ..... 100 31 836

(51) Int. Cl.[7] ..... B32B 3/06

(52) U.S. Cl. ..... 156/393; 156/439; 156/440; 156/177; 156/181; 264/DIG. 81

(58) Field of Search ..... 156/177, 180–181, 156/291, 296, 393, 439–441; 264/DIG. 81; 28/101

(56) References Cited

U.S. PATENT DOCUMENTS 3,607,565 A * 9/1971 Eaton ..... 156/440
3,616,067 A * 10/1971 Treckmann ..... 156/441
3,675,285 A * 7/1972 Atwood et al. ..... 28/100
3,993,379 A * 11/1976 Waller ..... 445/26
4,080,232 A * 3/1978 Friedrich ..... 156/177
4,172,748 A * 10/1979 Petzetakis ..... 156/177
4,823,564 A 4/1989 Wunner

FOREIGN PATENT DOCUMENTS

DE 3729344 3/1989

* cited by examiner

*Primary Examiner*—Sam Chuan Yao
(74) *Attorney, Agent, or Firm*—Smith, Gambrell & Russell, LLP

(57) ABSTRACT

A process and a device are suggested for the placement and fixing of a sheet, which is at least partially implemented as a closed flat structure, of filaments, lying essentially in a plane, for the production of scrims having the filament sheet, wherein the filament sheet is placed, as part of the filament sheet sections forming the closed surface and as separate filament sheet sections, between two conveyor units (13) supplying a connecting station (6), with the filament sheet sections (1) being fixed onto the conveyor unit at each of both end regions with a fixing element (2, 3) and the interval of the fixing elements (2, 3) of a filament sheet section (1) relative to the conveyor units (13) being selected in such a way that the filament sheet sections (1) are, in their fixed state, positioned essentially flat between the conveyor units (13), at least immediately before entering the connecting station (6).

14 Claims, 5 Drawing Sheets

Figure 1:
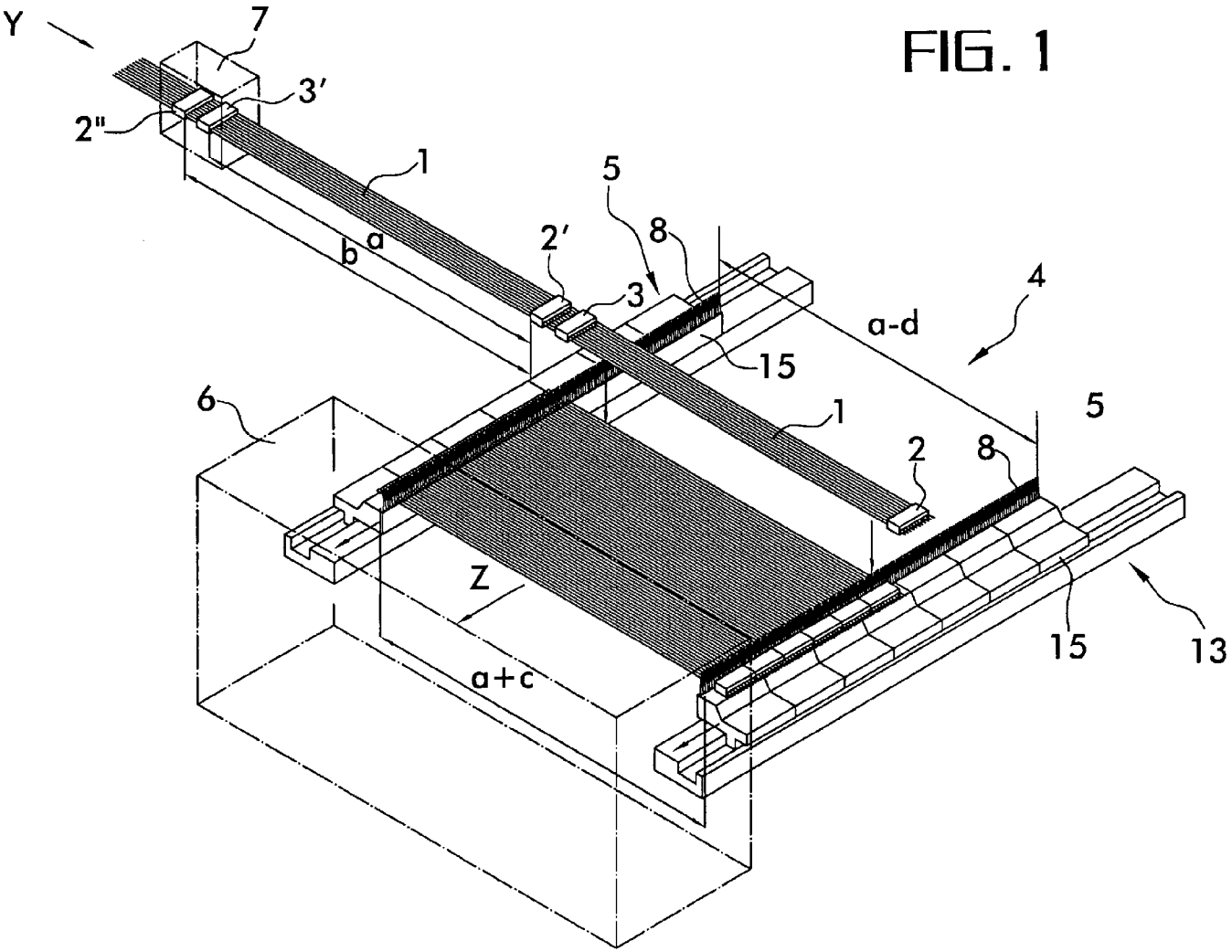

DEVICE FOR THE PLACEMENT AND FIXING OF A SHEET OF FILAMENTS FOR THE PRODUCTION OF SCRIMS

The invention concerns a process and a device for the placement and fixing of sheets of filaments, in the course of the production of scrims, which are implemented in a connecting station into a flat structure having, among other elements, the filament sheets.

The connecting station can, for example, be a warp knitting machine or a calender in which the previously placed and fixed filaments can be knitted and/or connected with one another in such a way that a flat scrim thereby arises. The filaments serve, on one hand, as so-called weft yarns in the production of scrims and, on the other hand, are increasingly used for purposeful reinforcement of the scrim to be produced, depending on their material. Placing these types of weft yarns continuously and in a meander shape by means of a weft carriage between two rows of needles moving forward via conveyor bands is known, with the yarns being hung on the rows of conveyor needles of a conveyor device. Lateral fixing of the weft yarns placed in this way is only required until the individual yarns are knitted or otherwise connected with one another in the connecting station. Subsequently, laterally projecting weft yarns can be cut off. These cut-off parts of the yarns are to be disposed of as filament waste of the production process.

Increasingly, these types of scrims for reinforcement are produced with high-value yarns and/or filaments, such as glass or carbon fibers. In this regard, the known methods for fixing and placement of the yarns have the disadvantage that on one hand, cost-intensive waste arises due to the cut-off remainders of high-value and thereby expensive yarns projecting at the edge of the scrim and, on the other hand, problems hereby arise because distortions and irregularities in the yarn guiding occur due to the twisting of the yarns or yarn sheets at the reversal points and/or around the conveyor needles, which leads to the placed and fixed yarns not forming a smooth plane. In the subsequent knitting process in a connecting station, this regularly leads to knitted materials of poor quality. The latter problem particularly arises when yarns are collected into so-called yarn sheets, because these cannot, and/or not without further means, be placed smoothly as flat bands around the rows of conveyor needles fixed laterally on the conveyor chains. The problem particularly occurs when so-called "heavy tows," i.e., filament sheets with a high number of filaments of a magnitude of approximately $10^4$, made of, for example, materials such as carbon or glass, are to be used for the production of scrims. Placement of these types of materials is, any case, only possible in very restricted cases (cf. Kettenwirkpraxis [Practical Warp Knitting] 2/96 p. 7).

The object of the present invention is to provide a process and a device for the placement and fixing of filament and/or yarn sheets, for the production of flat scrims, having an essentially uniform filament density, and to allow the use of filament sheets with various materials and to improve their secure fixing until connecting in a connecting station, particularly in a knitting station.

This object is achieved by a process with the features according to claim 1 and/or by a device with the features according to claim 11. Advantageous embodiments and further developments of the invention are objects of the respective sub-claims.

According to the process for placement and fixing of a filament sheet according to the invention, the filament sheet is placed as a filament sheet section between two conveyor units supplying a connecting station, with the filament sheet sections each being fixed onto the conveyor unit at each of their end regions with a fixing element and the interval of the fixing elements of one single filament sheet section relative to the conveyor unit being selected in such a way that, in their fixed condition, the filament sheet sections are positioned essentially flat between the conveyor units, at least immediately before entering the connecting station. Because the filament sheet is placed and fixed on the conveyor unit as separate filament sheet sections, each with fixing elements at their ends, the filament sheet is prevented from twisting, as in the meander-shaped placement, and thereby being placed out of its plane and thus irregularly. Rather, it is ensured with high reliability that the filament sheet, i.e., each individual filament of this filament sheet, is placed and fixed in a preset plane. In this way, not only is the quality of the scrim to be produced greatly improved, it is now also possible according to the invention to use relatively wide or stiff filament sheets or yarn sheets for processing into flat high-performance scrims. Furthermore, the resulting residues arising laterally on the scrim, which must be cut off and disposed of as waste, are reduced. Rather, the filament sheet sections can be exactly dimensioned in such a way that the fixing elements have exactly enough hold on the ends of the filament sheet sections to hold the filament sheet sections securely even under light pretension. The productivity of the production of scrims is thereby significantly increased, with the production able to be performed in less time and at lower cost. Because a weft carriage no longer places individual yarns, but rather wide filament sheet sections with an entire sheet of filaments, the placement speed can be increased. In addition, the variability in the placement of filament sheets can be increased with the process according to the invention, for example by also making multiaxial and multilayer placement of yarn sheets possible.

Although the filament sheets are placed without being twisted, good fixing by the lateral fixing elements is ensured at all times. The use of band-shaped filament sheet sections also has the advantage that, because they are a significantly less expensive starting material than individual yarns, the overall cost of the scrim to be produced can also be reduced.

According to an advantageous embodiment of the invention, the fixing elements are attached at a slant to the filament sheet section, i.e., to the lengthwise direction of the filament sheet section, at a selectable angle for diagonal placement of the filament sheet sections. This has the advantage that the strength of the scrim to be produced can be increased further, for example through superposition of straight and diagonally running filament sheet sections. The tensile strength of this type of material can thus be purposely adjusted according to the application in every direction. Because each filament sheet section is provided with two end fixing elements, they can be provided at any angle, i.e., of course also at any distance to one another, depending on the diagonal angle selected, and correspondingly be placed on the conveyor unit, with a reliable, and nonetheless very exact, placement, located in one single plane, of the filament sheets being ensured. The yarn sheets and/or yarn bands can thus not only be simply placed on top of one another, but can also be positioned and fixed unidirectionally, biaxially, or multiaxially in the placement range.

According to a further advantageous embodiment of the invention, the fixing elements of a filament sheet section are hung on holding needles of a conveyor unit. In this way, the individual filament sheet sections are securely fixed between the holding needles in a very simple way. Nonetheless, they can be easily hung as desired, even on top one another, and thereby fixed. For filament sheet sections which are laid on top one another, it is advantageous for the holding needles to have a radius of curvature, so that the individual filament sheet sections have a uniform tension over the working width due to the greater thickness of the fixing elements at the end regions. Continuous, uniform placement and fixing is possible in this way, independent of the individual filament sheet section. The hanging or also removal of filament sheet sections can be performed rapidly and with simple means.

According to a further advantageous embodiment of the invention, the fixing elements are produced by embedding the end regions of the filament sheet sections, preferably in a rapidly hardening plastic or a metal and/or a eutectic metal alloy. This has the advantage of great practicability, because the fixing element can be easily connected with the filament sheet section, independent of the material. In addition, these fixing element sheet sections are extremely economical and also can be relatively rapidly produced in the connecting station, depending on the processing speed. This type of fixing element also has the advantage that, after solidification, it is extremely solid and thereby provides the filament sheet section a secure hold on all of the filaments connected with it, and nonetheless has favorable properties in regard to weight and material costs.

According to a further advantageous embodiment of the invention, the fixing elements are produced by gluing of the end regions of the filament sheet sections. This has the advantage that fixing elements can be produced, even at very high speeds, with rapidly hardening materials and, furthermore, with any desired fixing element parts in the material. The placement and fixing speed can thus be further increased.

According to a further advantageous embodiment of the invention, the process has the following steps:

Attachment of a first fixing element 2' to the filament sheet;

Gripping of the first fixing element 2' and movement of the fixing element 2' by a preset distance b;

The application of a second fixing element 3' to form the first filament sheet section and preferably also a first fixing element for the subsequent filament sheet section;

Cutting off the first filament sheet section and hooking or pressing the fixing element into the respective holding needles or, conversely, first hooking or pressing and then cutting off the filament sheet section.

The individual process steps described can hereby be performed continuously and synchronously for each following filament sheet section, so that no delay of the actual connecting procedure in the connecting station occurs due to the production of the filament sheet sections provided with the fixing elements. It is, however, also possible to implement the second fixing element of the first filament sheet section and the first fixing element of the subsequent filament sheet section in one piece and then to cut them apart. With a few very simple steps, very high-quality scrim materials can thus be produced. Through use of reinforcement filament sheets, which is purposeful in regard to material and placement, the variability in the production of high-performance knitted scrims is significantly increased.

According to a further advantageous embodiment of the invention, a predefined filament sheet tension is applied to the individual filament sheet section in the process step d of the present invention between cutting and hooking and/or pressing. In this way, it is ensured that each filament sheet, and thereby also each filament in a filament sheet, is connected to the scrim in the connecting station with a uniform pretension, so that the elements are evened out as much as possible before possibly marked undulations and no distortions or irregularities arise in the filament density and thereby in the stretching and tensile properties of the scrim due to irregularly tensioned filament sheet sections.

According to a further advantageous embodiment of the invention, the filament sheet sections are produced in coordination with the supply speed of the rows of needles. In this way it is ensured that the placement and fixing steps can be optimally adjusted to the operating speed of the following connecting station. Therefore there is no delay or overtaking of, on one hand, the preparation steps of placement and fixing and, on the other hand, of the connecting of the scrim having the filament sheets as a part.

According to a further advantageous embodiment of the invention, several filament sheet sections are placed and fixed on top of one another. In this way, on one hand, the strength of the scrim to be produced can be increased further, and, on the other hand, the thickness of the scrim can be controlled.

The device for placement and fixing of the filament sheets implemented as a closed surface according to a first exemplary embodiment of the invention has parallel conveyor chains which supply continuously, a placement unit for laying the filament sheet, and a holding unit for at least temporary fixing of the placed filament sheets, with the sheets being supplied to a connecting station for production of flat scrims and with a unit for the production of prefabricated filament sheet sections being provided. This unit produces filament sheet sections which are provided at a preset interval with fixing elements and which can be attached to the supplying conveyor chains in such a way that, at least at the connecting station, the filament sheet sections are held in such a way that they are implemented there as an essentially flat surface. Thus, the individual filament sheet sections provided with fixing elements can not only be produced very easily in accompaniment with the process, but they can also be placed and fixed, without complicated holding or placement mechanisms, in the holding devices provided on the conveyor chains. The interval of the conveyor chains of the device and interval of the fixing elements are adjusted to one another in such a way that it is, in fact, not necessary for the filament sheet to be tensioned between the conveyor chains at the moment of placement, but that, at latest shortly before the connecting station, all of the filament sheet sections placed in the device are positioned uniformly and thus essentially in one plane, i.e., are fixed with pretension.

According to advantageous embodiment of the invention, the holding unit has a row of guide needles and a row of holding needles into which the fixing elements can each be hooked and/or pressed. For example, in a filament sheet with individual filaments, which are positioned very close to one another, the guide needles can be implemented as so fine that channels hardly arise in the filament sheet. In addition, it is hereby ensured that the filament sheet sections are held securely as they enter the connecting station, they are fixed in their position, and they have a uniform filament density. The device thus has a very simple construction and functions with a few breakdowns and little need for maintenance.

According to a further embodiment of the invention in this regard, the placement unit has a gripper unit, which can be moved and lowered, having at least one presser, one gripper, and one cutting knife. The gripper unit can thereby be moved transversely or diagonally to the supply direction of the conveyor unit as desired, so that filament sheet sections produced, i.e., provided with fixing elements, laterally to the placement direction can be gripped by the gripper and, after traveling over the placement device into the corresponding opposite row of holding needles, can be pressed by one or more pressers into the row of needles. The cutting knife serves for cutting off individual filament sheet sections from the endless roll of filament, with this preferably occurring after hanging on both ends, i.e., fixing of a filament sheet section, and preferably at the rear end in the direction of placement, before the following section can be picked up by the gripper of the gripper unit.

According to a further advantageous embodiment of the invention, the holding needles of the holding device are of a length such that several fixing elements, and thereby several filament sheet sections, can be hooked into them on top of one another. Because the holding needles are positioned below the row of guide needles, the holding needles can be implemented sufficiently long for this purpose without interfering with other functions of the device. In this way, high-strength scrims, i.e., those having several layers of filament sheet sections on top of one another, can also be produced.

According to a further advantageous embodiment of the invention, the interval of the holding needles positioned on the respective conveyor chains increases in the direction of movement of the conveyor chains to pretension the filament sheet sections. This has the advantage that the interval between the holding needles can be reduced in such a way that, at the placement position at which the individual filament sheet sections are placed, the hanging by means of the gripper unit is made significantly easier and nonetheless, at least at the connecting station, the filament sheet sections are uniformly fixed and tensioned and can also not pop out of the holding device under any circumstances.

According to a further advantageous embodiment of the invention, the holding unit on the conveyor chains only has one row of holding needles. In this case, the holding needles assume the double function of transportation and/or guiding of the filament sheet sections and, simultaneously, fixing and holding. Because the holding needles are positioned below the uppermost edge of the conveyor chains, the filament sheet sections are guided via this edge and are thereby uniformly supplied to the connecting station to maintain an essentially constant filament density without the formation of channels. The device has a constructively simple design, has fewer single parts, and nonetheless ensures easy placement and fixing, even of so-called "heavy tows" for the production of high-performance scrims.

According to a further advantageous embodiment of the invention, a device for the production of the filament sheet sections is provided which allows fusing, embedding, and/or gluing, and/or freezing of the fixing elements with the filament sheet sections. While fusing has the advantage of an extremely solid bond of the fixing elements with the filaments, rapid connecting of the fixing elements with the filament sheets can be achieved, independent of the material, with gluing. Embedding and/or casting in has the advantage that the filament sheet does not fuse with the fixing elements and thus can be removed again by heating if necessary. Freezing of the filament sheet sections to fixing elements at the end regions not only has ecological advantages, but is also extremely economical and, nonetheless, ensures secure fixing, i.e., attachment, of the fixing elements to the filament sheet sections. In addition, lateral remainders can be supplied to a recycling center without contaminants after thawing.

According to a further advantageous embodiment of the invention, an angle, at which the fixing elements can be fixed to the filament sheet section at a slant, can be set on the device. In this way, individual filament sheet sections can be placed not only at 90°, but also diagonally at any desired angle, with the filament sheet sections nonetheless able to be inserted and fixed securely.

According to an embodiment of the invention related to this, a control unit is provided for control of the placement unit and the unit for production of the filament sheet sections. The control unit can hereby be used, on one hand, for control of the placement geometry, i.e., the axial alignment, and, on the other hand, for the control of the placement and fixing speeds of the device, which are adjusted to the production process of the scrim.

Figure 2:
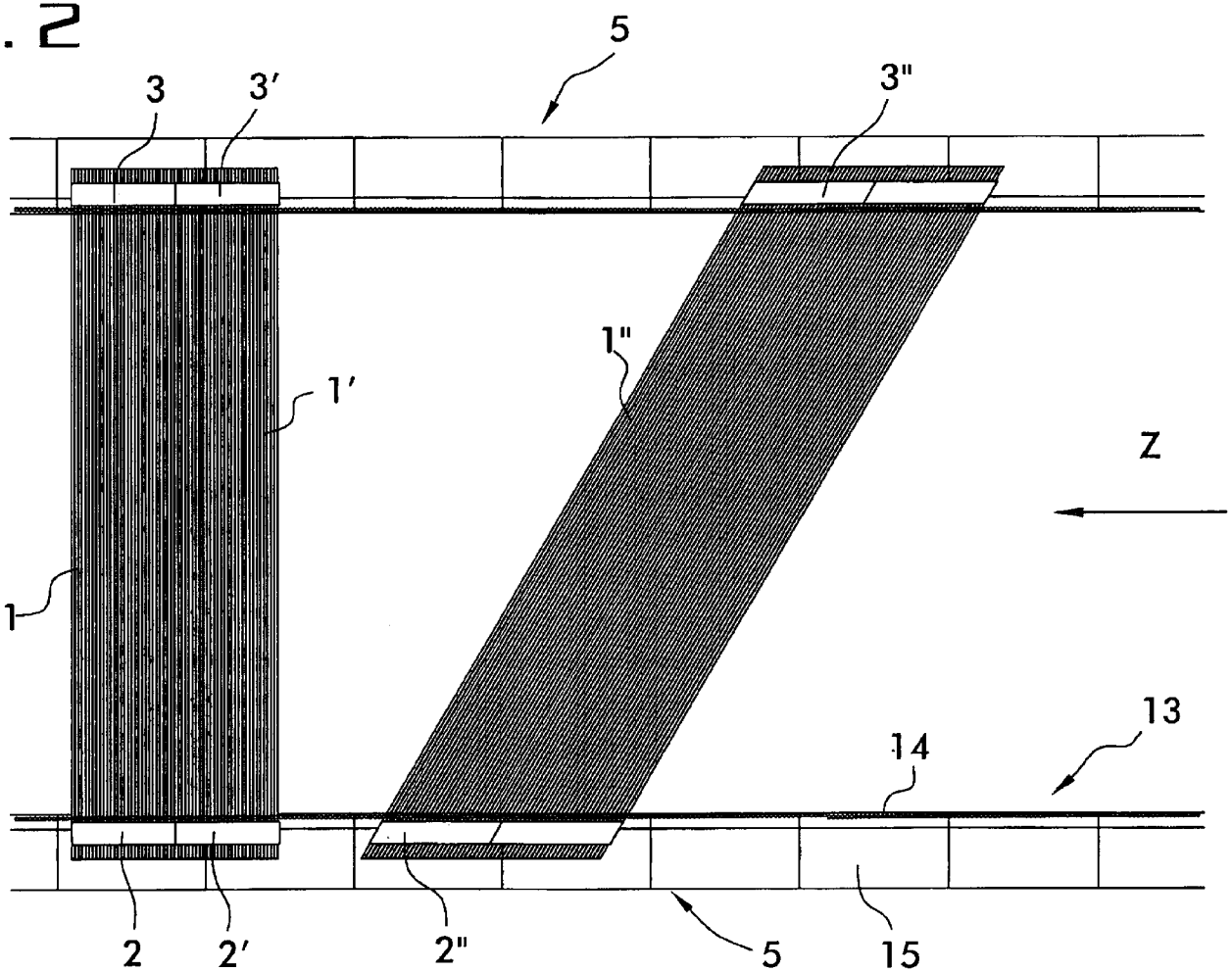
Figure 3A:
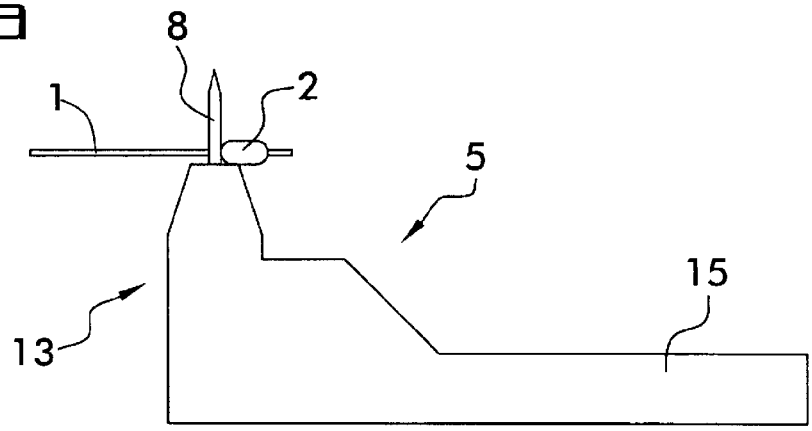
Figure 3B:
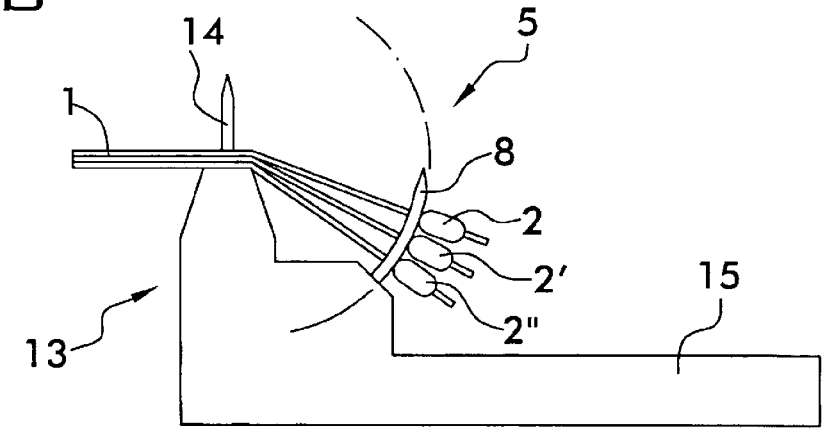
Figure 3C:
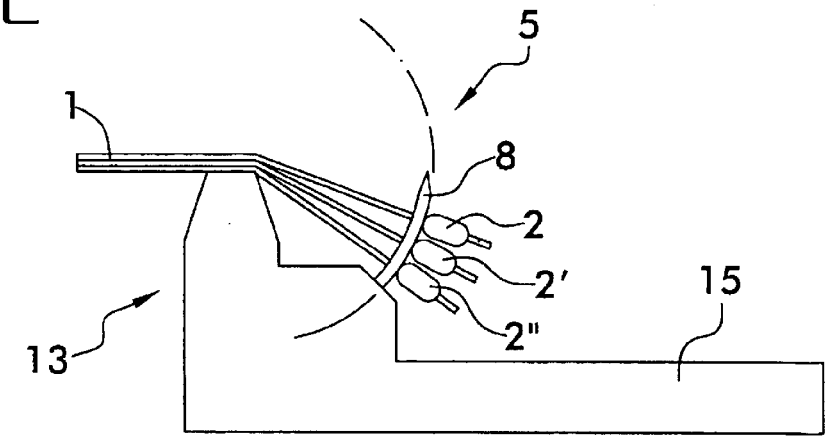
Figure 4:
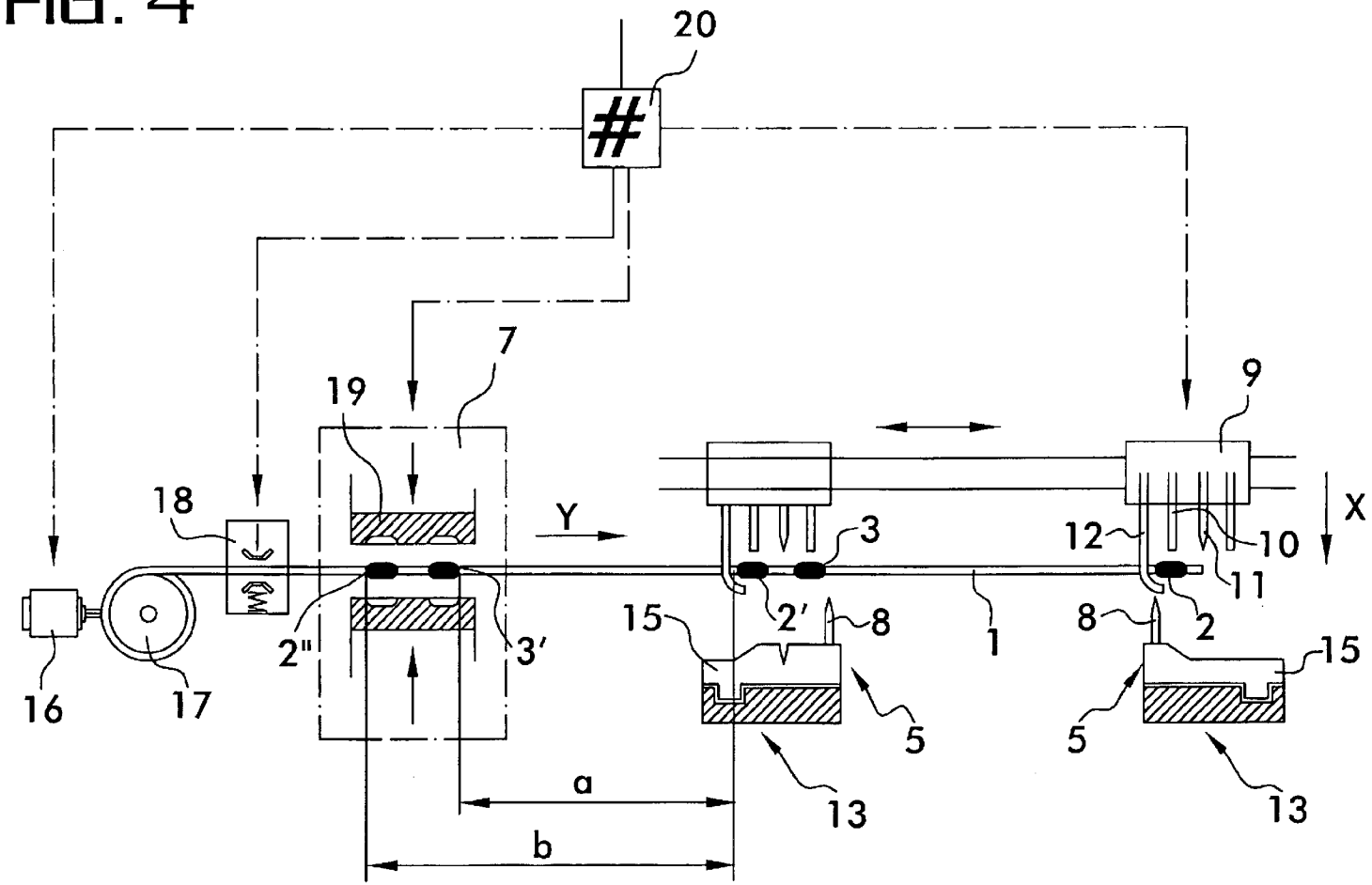
Figure 5A:
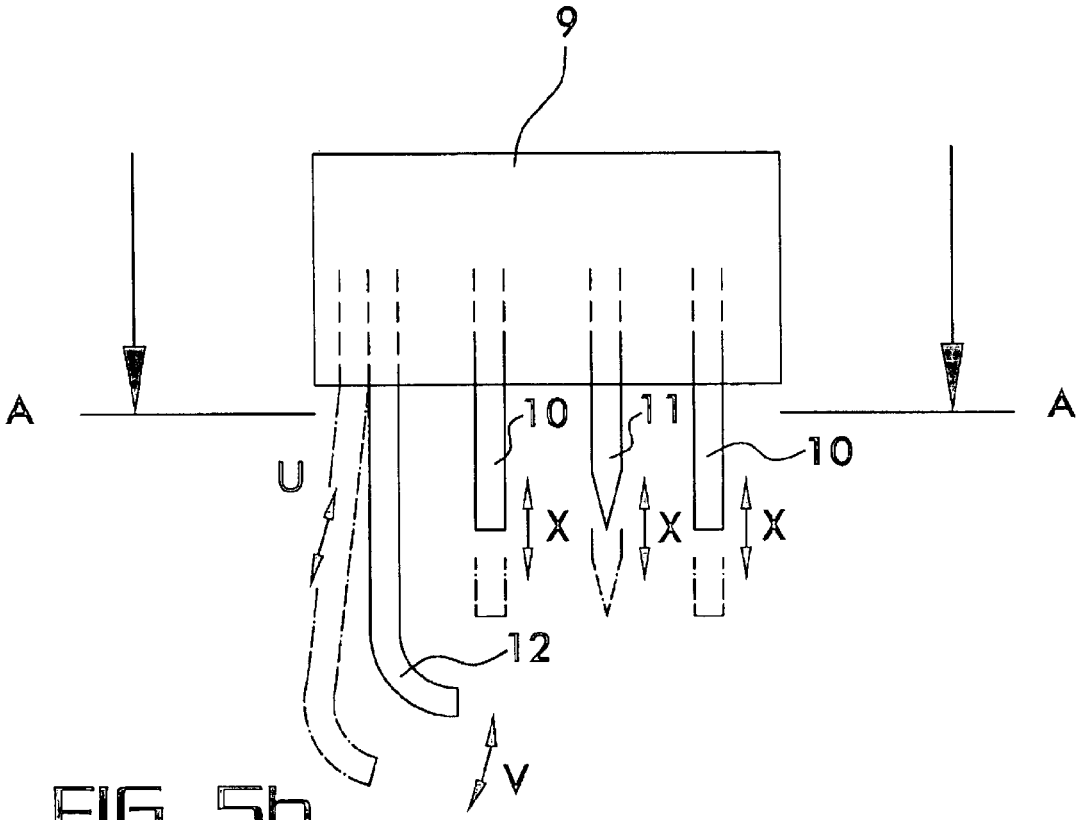
Figure 5B:
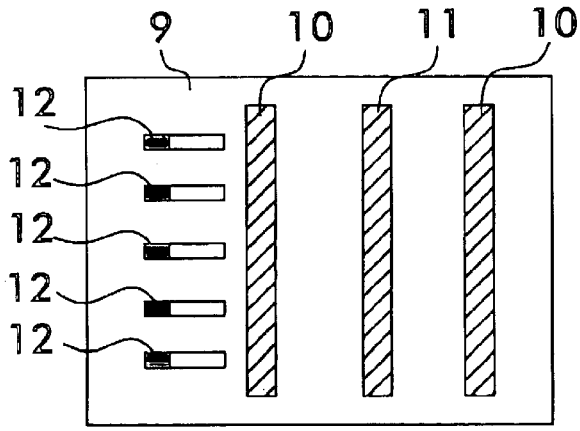

In the following, the invention will be described in detail with reference to exemplary embodiments and the drawings. The drawings show:

FIG. 1 a schematic illustration of an exemplary embodiment of the placement and fixing device according to the invention in perspective view;

FIG. 2 a top view of the device according to FIG. 1, with one filament sheet placed diagonally and one at 90°;

FIG. 3*a* an exemplary embodiment of a holding unit in a side view, in which a filament sheet section is fixed by holding needles positioned on the uppermost surface of the conveyor chains;

FIG. 3*b* an exemplary embodiment of a holding unit of the device according to the invention in a side view, in which several filament sheet sections are fixed on top of one another in holding needles positioned below a row of guide needles;

FIG. 3*c* a further exemplary embodiment of a holding unit of the device according to the invention in a side view, in which the row of guide needles according to FIG. 3*b* is left out;

FIG. 4 a device for placement and fixing according to the invention having a gripper unit and a control unit in a simplified side view;

FIG. 5*a* a gripper unit of the device according to FIG. 4 illustrated in principle in a side view;

FIG. 5*b* a gripper unit according to FIG. 5*a* in a sectional view in the plane A.

In FIG. 1, a placement and fixing device according to the invention is illustrated in a simplified perspective view. A filament sheet section 1, which consists of a group, i.e., a sheet, of individual filaments positioned next to one another and has fixing elements 2, 3 at each of its end regions, is laterally supplied to a placement unit 4 and a holding unit 5, in order to subsequently supply it in the supply direction Z to a connecting station 6 (not shown), e.g., a warp knitting machine, for further processing of the filament sheet sections into a knitted scrim.

The filaments supplied in a band shape are provided with fixing elements in a unit 7 positioned laterally to the placement unit 4 and the holding unit 5. This means that the filament sheet is supplied, as an endless band in the placement direction Y, to the unit 7, in which means are provided for attaching fixing elements 2, 3 to the filament sheet at preset intervals.

The fixing elements 2, 3 can hereby be attached to the filament sheet 1 in various ways, e.g., by gluing, by embedding in plastics, by the application of clamping elements, or by freezing. It is hereby clear to those skilled in the art that every suitable means of attachment of the fixing elements can be used, as long as the fixing elements 2, 3 are attached to the filament sheet sections 1, at least until the connecting station 6 has been passed, in such a way that essentially all of the filaments are held by the fixing elements. The fixing elements 2, 3 are attached at a preset interval a to the filament sheet 1 in such a way that the previously placed and fixed filament sections 1, which are later cut off, are positioned and fixed essentially flat and possibly with slight pretension in the holding unit 5, at least until shortly before the connecting station 6. The overall length of a yarn sheet section is hereby represented by b.

The filament sheet sections 1 continuously produced in this way are moved by a gripper unit 9, not shown in FIG. 1, in the placement direction Y over the placement unit 4 and the holding unit 5 and laid and/or pressed into them from above. Subsequently, the individual filament sheet section 1 is cut off from the continuous filament sheet roll by the cutting knife, not shown in the drawing, and the following filament sheet section 1, which is also already provided with fixing elements 2', 3', is supplied to the placement unit 4 and the holding unit 5 analogously to the preceding yarn sheet section 1.

In the exemplary embodiment illustrated in FIG. 1, the conveyor unit 13 consists of the conveyor chains 15 and/or conveyor chain links, which are moved forward on a guiderail in the supply direction Z of the connecting station. Holding needles 8 are provided on the top of the conveyor unit 13. The individual filament sheet sections are pressed and/or laid next to one another and in sequence in these holding needles 8 by means which are not shown in the figure. The interval of the holding needles 8, which are positioned essentially parallel to one another, is selected in such a way that, at least shortly before entering the connecting station 6, the interval of the holding needles 8 corresponds to the interval a of the fixing elements 2, 3 of a filament sheet section 1 plus an addition c which effects the tensioning of the yarn sheet sections. At the laying station of the placement unit 4, the interval selected between the holding needles can be correspondingly smaller, i.e., an interval a–d, in order to insure a light, tension-free laying and/or pressing of the filament sheet section with its fixing elements 2, 3 into its placement position.

FIG. 2 is a top view of the device according to the invention from FIG. 1 with filament sheets placed diagonally and straight. Identical parts are provided in FIG. 2 with the same reference numbers as in FIG. 1. This figure illustrates the great variability of the process and device according to the invention in the placement of filament sheets. The individual filament sheet sections 1, 1' can also be placed and appropriately fixed diagonally, on top of one another, or next to one another as desired. According to the diagonal angle selected, The fixing elements 2", 3" are correspondingly attached to the filament sheets 1' diagonally and at a preset interval in the unit 7, not shown in FIG. 2, for attaching fixing elements 2", 3." It is obvious that straight filament sheet sections 1 and diagonal filament sheet sections 1' can also be placed and fixed on top of one another in the device according to the invention. In this way, high-quality scrims, which are stiffened with filament sheet sections and, for example, also reinforced appropriately for the flow of force, can be produced to optimally correspond to mechanical strains.

FIG. 3*a* shows a layout in principle of a first exemplary embodiment of the invention in regard to the fixing of a yarn sheet section 1 on the holding needles 8. The yarn sheet sections have fixing elements 2 fixed at both ends at an interval such that, in their condition as they are hung in the holding needles 8, the fixing elements engage directly behind the holding needles 8, corresponding to the interval of the holding needles 8 from one another on the conveyor chains 15, so that the filament sheet sections 1 are positioned—as shown—in a horizontal plane, i.e., in a slightly tensioned condition, at least directly before entering the connecting station (not shown). The holding needles 8 are positioned on the uppermost surface of the respective conveyor chains 15.

An exemplary embodiment of a holding unit is illustrated in FIG. 3*b* in a side view with several filament sheet sections on top of one another. The filament sheet sections 1 placed on top of one another are hung by their ends having fixing elements 2, 2', 2" behind a row of holding needles 8 of the holding unit 5. The holding unit 5 is attached on a conveyor unit 13 in such a way that the holding needles 8 are positioned, on one hand, outside the connecting region and, on the other hand, below the row of guide needles 14, which is attached to the top of the conveyor chain 15. It is thus clear that secure fixing of the filament sheet is ensured with simple means and the filament sheet sections 1 are positioned essentially flat in the connecting region.

This is significant for the production of high-quality scrims which are reinforced with filament sheet sections made of any desired material, but preferably carbon or glass fibers.

FIG. 3*c* illustrates a further exemplary embodiment of a holding unit in a side view and in detail with multiple filament sheet sections on top of one another. In contrast to FIG. 3*b*, in this exemplary embodiment the row of guide needles 14 is left out. The holding needles 8 hereby assume a double function, namely, on one hand, holding the filament sheet sections 1 on their fixing elements 2, 2', 2" and, on the other hand, the transport of the placed and fixed filament sheet sections and/or their guiding in the direction of the connecting station (not shown here).

FIG. 4 shows a device for placement and fixing according to the invention with a gripper unit 9 and a control unit 20 in a schematic illustration. The entire process sequence for the production of the filament sheet sections 1, up to the placement of the filament sheet sections 1 produced in the placement unit 4 and/or holding unit 5, is visible in this figure. A raw material supplied as an endless roll, i.e., as a filament sheet roll 17, is rolled off via a drive 16. Subsequently, the filament sheets rolled off are guided through a station 18, in which quality features such as thickness, density, and tension of the filament sheet can be adjusted and/or monitored. In the following unit 7 for the production of filament sheet sections, a fixing element embedding unit 19 is provided with which fixing elements 2, 3, made of, for example, plastic, can be fused onto the filament sheets. It is obvious that any other suitable type of attachment of the fixing elements 2, 3 to the filament sheets 1 can be provided. Subsequently, the forward fixing element 2 is gripped with a gripper 12 via a gripping unit 9 and moved over the holding unit 5 in the placement direction Y. The unit 7 is hereby positioned relative to the holding unit 5 in such a way that a preset adjustable interval a between the fixing elements 2, 3 is maintained. It is hereby ensured that fixing elements which are always tailored to the interval of the holding elements are attached to the filament sheet.

The gripper unit 9 also has a presser 10 and a cutting knife 11, with the presser 10, in the placement position of the gripper unit 9, pressing the fixing elements down and/or into the holding needles 8 of the holding unit 5 in the pressing direction X. The gripper unit 9 then travels back along the placement direction Y to the location of the second fixing element 3 of the first filament sheet section 1, presses it as described by means of the presser 10 into the holding unit 5 at this position behind the holding needles 8 and cuts off the filament sheet section 1 behind the fixing element by means of the cutting knife 11. The procedure described is, depending on the scrims to be produced, repeated multiple times or continuously, with the conveyor unit 13 able to continuously move further during the superposition and fixing of filament sheet sections 1. In this exemplary embodiment, the control unit 20 is provided, which monitors the drive 16, the station 18, the unit 7 for production of filament sheet sections, and the gripper unit 9, and controls each of these in coordination with one another. The control of the placement and fixing device is advantageously performed in such a way that it is adjusted to the speed of the connecting process in the connecting station, which is not shown in the figure.

In FIGS. 5*a* and 5*b*, the gripper unit of the device from FIG. 4 is shown in detail, once in a side view and once in a sectional top view. The individual movement sequences of the gripper unit 9 are illustrated here again. The gripper 12 is, on one hand, moved in the gripper grip direction U, and, on the other hand, it performs a movement in the gripper pivot direction V. In this way, a filament sheet section is gripped behind its fixing element.

The two pressers 10 are moved in the pressing direction X when the gripper unit 9 is over the holding unit 5 (not shown here), i.e., behind the holding needles 8. It is illustrated in the sectional view according to FIG. 5*b* that the presser 10 and the cutting knife 11 are elements which can travel over the entire width of the filament sheet 1, while, in contrast, the gripper 12 must be implemented as claw-like and as narrow as possible in order to be able to grip through the filament sheet and behind the corresponding fixing elements 2, 3.

List of Reference Numbers

1 Filament sheet section
1' Diagonally placed filament sheet section
2, 3 Fixing elements
4 Placement unit
5 Holding unit
6 Connecting station (warp knitting machine)
7 Unit for application of the fixing elements
8 Holding needles
9 Gripper unit
10 Presser
11 Cutting knife
12 Gripper
13 Conveyor unit
14 Guide needles
15 Conveyor chain (chain links)
16 Drive
17 Filament sheet roll (raw material)
18 Station for adjustment and/or monitoring of quality features
19 Fixing element embedding unit
20 Control unit
a Preset interval of fixing elements
b Total length of a yarn sheet section
c Addition to interval
d Reduction in interval
X Pressing direction
Y Placement direction
Z Connecting station supply direction
U Gripper grip direction
V Gripper pivot direction
β Diagonal angle of filament sheet section

What is claimed is:

1. Apparatus for the placement and fixing of a sheet of filaments, lying essentially in a plane, for the production of scrims in a connecting station, comprising in combination, a. a station for the production of premanufactured filament sheet sections having ends held by fixing elements at a preset interval, b. conveyor chains continuously supplying said connecting station, c. a placement means for placement of said filament sheet sections onto said conveyor chains, d. a holding means for at least temporary fixing of the placed filament sheet, said holding means being affixed to said conveyor chains in such a way that said filament sheet sections are held in such a way that said filament sheet sections are presented to said connecting station as an essentially flat surface.

2. Apparatus for the placement and fixing of a sheet of filaments for the production of scrims as described in claim 1 wherein said holding means has at least one row of holding needles into which said fixing elements can be hooked.

3. Apparatus for the placement and fixing of a sheet of filaments for the production of scrims as described in claim 2 wherein said holding needles are of a length such that more than one fixing element can be hooked in on top of one another.

4. Apparatus for the placement and fixing of a sheet of filaments for the production of scrims as described in claim 2 wherein said holding needles are curved outwards and are located below rows of guide needles.

5. Apparatus for the placement and fixing of a sheet of filaments for the production of scrims as described in claim 1 wherein said holding means has two opposing rows of holding needles, and the interval between said opposing holding needles increases for pretensioning of said filament sheet section.

6. Apparatus for the placement and fixing of a sheet of filaments for the production of scrims as described in claim 1 wherein said holding means has two opposing rows of guide needles and two opposing rows of holding needles which supply said connecting station synchronously.

7. Apparatus for the placement and fixing of a sheet of filaments for the production of scrims as described in claim 1 wherein said placement means comprises a gripper which can be moved and lowered, said gripper having at least one presser, at least one gripper, and at least one cutting knife.

8. Apparatus for the placement and fixing of a sheet of filaments for the production of scrims as described in claim 1 wherein said station for production fuses said fixing elements onto said filament sheet section.

9. Apparatus for the placement and fixing of a sheet of filaments for the production of scrims as described in claim 1 wherein said filament sheet section has a longitudinal dimension and said fixing elements are attached to said filament sheet section at a selectable angle to said longitudinal dimension for diagonal placement of said filament sheet section.

10. Apparatus for the placement and fixing of a sheet of filaments for the production of scrims as described in claim 1 further comprising a control unit provided for control of said placement unit and said station for production.

11. Apparatus for the placement and fixing of a sheet of filaments for the production of scrims as described in claim 1 wherein said holding means has at least one row of holding needles into which said fixing elements can be pressed.

12. Apparatus for the placement and fixing of a sheet of filaments for the production of scrims as described in claim 1 wherein said station for production embeds said fixing elements onto said filament sheet section.

13. Apparatus for the placement and fixing of a sheet of filaments for the production of scrims as described in claim 1 wherein said station for production glues said fixing elements onto said filament sheet section.

14. Apparatus for the placement and fixing of a sheet of filaments for the production of scrims as described in claim 1 wherein said station for production freezes said fixing elements onto said filament sheet section.

* * * * *